US005163565A

United States Patent [19]

Caskey

[11] Patent Number: 5,163,565

[45] Date of Patent: Nov. 17, 1992

[54] SYSTEM FOR SEPARATING PARTICLES IN A ROTARY SEPARATOR

[75] Inventor: Richard A. Caskey, Corvallis, Oreg.

[73] Assignee: The United States of America as represented by the Secretary of Agriculture, Washington, D.C.

[21] Appl. No.: 764,732

[22] Filed: Sep. 24, 1991

[51] Int. Cl.[5] ..... B07B 13/02

[52] U.S. Cl. ..... 200/687; 209/707

[58] Field of Search ..... 209/684, 686, 687, 645, 209/707, 700, 689

[56] References Cited

U.S. PATENT DOCUMENTS

| | | | |
|---|---|---|---|
| 854,443 | 5/1907 | Voorhees | 209/687 X |
| 1,437,042 | 11/1922 | Carter | 209/684 |
| 1,932,777 | 10/1933 | Germer | 209/687 |
| 2,478,246 | 8/1949 | Cortese et al. | 209/687 X |
| 2,672,235 | 3/1954 | Freeman | 209/687 |

FOREIGN PATENT DOCUMENTS

| | | | |
|---|---|---|---|
| 741959 | 7/1980 | U.S.S.R. | 209/687 |
| 1204276 | 1/1986 | U.S.S.R. | 209/687 |
| 1207530 | 1/1986 | U.S.S.R. | 209/687 |

OTHER PUBLICATIONS

Hart uni-flow Grain Separator sales brochure, date Feb. 1942.

*Primary Examiner*—Donald T. Hajec

*Attorney, Agent, or Firm*—M. Howard Silverstein; John D. Fado

[57] ABSTRACT

A rotary drum separator is provided having a plurality of elongated pockets that extend in the direction of pocket movement, wherein more than one kind of particle in a bulk mixture in the drum longitudinally may lodge in the pockets; wherein each of the pockets includes a generally flat upstream surface so that a particle longitudinally lodged therein partly rests or stands upon the generally flat surface when elevated above the bulk mixture. Diverse particles having about the same width and depth, but a different length, are able to be lifted by the pockets, but the longer ones are lifted higher above the bulk mixture. If the shorter particles also have a different shape than the longer ones so that the shorter ones are lodged less stably in the pockets than the longer ones, this difference will contribute to an earlier departure of the shorter particles from the pockets. In an alternative embodiment, the diverse particles have about the same size, shape, and mass, but one of the particles has a higher center of mass than the other with respect to ledge support. In this embodiment, the particles having a higher center of mass are lifted higher above the bulk mixture than the ones with a lower center of mass.

11 Claims, 4 Drawing Sheets

SYSTEM FOR SEPARATING PARTICLES IN A ROTARY SEPARATOR

FIELD OF THE INVENTION

This invention relates to the use of rotating drums to separate particles from one another.

PRIOR ART

It is known in the prior art to use a rotating rotating drum, known as an indent cylinder separator or trier, to separate particles from one another, on the basis of size, from a bulk mixture within the drum. The interior surface of the drum includes pockets or indentations, typically in the shape of half spheres or tear drops, sized so that the shorter or smaller particles, but not the larger or longer ones, may lodge securely in the pockets. An the drum rotates on its axis, particles lodged in the pockets are lifted until gravity overcomes (a) centrifugal force and (b) the physical interactions between the particles and the pockets that hold the particles in the pockets, so that such particles that are most securely lodged on the pockets, i.e., the shorter or smaller particles, are lifted high enough to be intercepted by a trough as they fall back toward the bulk mixture.

In this manner, the bulk mixture becomes depleted of the shorter particles, and enriched with the longer ones, while the batch of intercepted particles predominantly is composed of the shorter particles.

These devices are well known with regard to separating crop seed from contaminants including weed seed. In the separation of short crop seeds from long weed seeds, the shorter crop seeds can lodge securely in the appropriately sized pockets and can then be lifted from the bulk mixture to a separate storage area. As the crop seeds are removed, the contaminant/crop seed ratio of the nulk material remaining in the lower part of the drum increases, thereby increasing the opportunity for longer weed seeds to be lifted inadvertently with crop seed. To insure against this, a large portion of crop seed may be allowed to remain with the contaminants in the bulk material. This highly contaminated bulk material that includes otherwise salable crop seed, often is thrown away, or expensively reconditioned to separate out the crop seed. In addition, some of the best crop particles often are the largest seed, as well as the longest, but because of such size, will not lodge securely in the pockets, and end up as a high percentage of the discarded bulk material.

SUMMARY OF INVENTION

I now have invented a new pocket for a rotary drum separator that preferentially lifts longer particles from the bulk mixture, rather than shorter ones, to a separation trough or tray. Broadly, the invention comprises a plurality of elongated pockets, extending in the direction of pocket movement, in which the particles longitudinally may lodge. Each pocket has a generally flat upstream surface.

In a bulk mixture of long and short particles, such as long weed seed and short crop seed, both particles are able to lodge longitudinally in the pockets of the present invention. As the rotating drum causes a particle-containing pocket to move above the bulk mixture, the generally flat upstream surface of each pocket becomes horizontally disposed to function as a ledge upon which a lodged particle partly may rest or stand, and then the ledge begins to slope at a progressively greater angle as drum rotation continues.

When the ledge reached what might be deemed a critical angle, both the longer and shorter particles begin to topple out of the pockets. The shorter ones topple out faster because such particles typically have a smaller mass moment of inertia with respect to ledge support. Thus, the longer particles do not completely escape their respective pockets until such pockets reach a higher elevation above the bulk mixture than the pockets containing the shorter particles, so that a separation can be achieved by intercepting the later falling longer particles while the non-intercepted shorter ones return to the bulk material.

This phenomena is better understood with regard to pendulums, wherein shorter pendulums exhibit a greater angular velocity than longer ones, e.g., a shorter pendulum will swing more rapidly through a given arc than a longer one. For the same reason that a shorter pendulum has a greater angular velocity than a longer one, a shorter particle is able to topple over faster than a longer one.

The methodology of this aspect of the present invention may be described as follows:

a. lifting first and second particles out of a bulk mixture in a rotary separator by means of pockets; wherein the first particles are about the same width and depth, but are shorter than, the second particles;

b. causing the first and second particles to begin toppling out of the pockets at about the same elevation or height above the bulk mixture, but causing the first particles to topple out more rapidly than the second ones so that the first particles completely escape their respective pockets at a lower elevation above the bulk mixture than the second ones.

A separation between longer and shorter particles further is enhanced if the shorter particles have a more rounded shape than the longer ones, so that the shorter particles are supported less stably in a pocket, and thereby tend to begin falling out of a pocket at a lower elevation above the bulk mixture than the longer ones. This difference in shape exists between goatgrass seed and wheat seed. Thus, in this embodiment, in addition to employing the difference in mass moments of inertia to cause shorter particles to completely escape their respective pockets at a lower elevation than longer ones, some of the shorter particles are caused to escape at a lower elevation as a result of difference in shape.

In another embodiment of the invention, the particles may have the same shape and length, but different centers of gravity or mass. The difference in centers of mass essentially has the same effect as different lengths. For instance, assume than two particles of the same shape and length are vertically positioned on a ledge, and assume that one of the particles has a lower center of mass than the other. This lower center of mass translates into being the shorter of the two particles under the "pendulum effect" described above, so that the particle with the lower center of mass will topple over with greater rotational speed than the particle with a higher center of mass.

The methodology of this latter embodiment therefore comprises:

a. lifting first and second particles out of a bulk mixture in a rotary separator by means of pockets; wherein the second particles have the same shape, size, and a mass as the first particles, but have a higher center of mass than the first ones relative to, or with respect to, a particle's point of support in its respective pocket;

b. causing the first and second particles to begin toppling out of the pockets at about the same height above the bulk mixture, but causing the second particles to topple out more slowly than the first ones so that the second particles completely escape their respective pockets at a higher elevation above the bulk mixture than the first ones.

The system of the present invention is especially useful for the seed conditioning industry. For example, wheat grown for seed that is infested with the weed, goatgrass, has resale and transportation restricted by state and federal seed laws. Removing the goatgrass from the wheat increases its worth.

Therefore some of the objects of the present invention are to:

a. Separate particles of different shapes, such as ellipsoidal particles (i.e., egg shaped) from cylindrical particles.

b. Preferentially lift longer particles rather than shorter ones from a bulk mixture.

c. Preferentially lift from a bulk mixture particles that are more stable due to particle shape, and diverting them to a trough.

d. Separate crop seeds from weed seeds.

e. Preferentially lift jointed goat grass seed out a bulk mixture with wheat seed.

f. Preferentially lift from a bulk mixture particles that have higher centers of mass than particles with lower centers of mass.

Other objects and advantages will be obvious from the more detailed description of the present invention taken with figures in which:

FIG. 1*a* is a front sectional view of the overall apparatus of the present invention.

FIG. 1*b* is a side sectional view of the overall apparatus.

FIGS. 2*a* and 2*b* are partially sectional side views of the pockets of the present invention.

FIG. 3*a* is a front view of the pockets.

FIGS. 3*b* and 3*c* are additional side sectional views.

FIG. 3*d* is a cross-sectional view of the pockets.

Figure 6A:
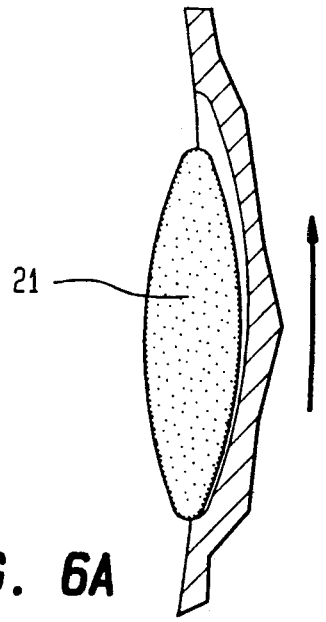

FIG. 6*a* is sectional side of still another alternative pocket.

Figure 6B:
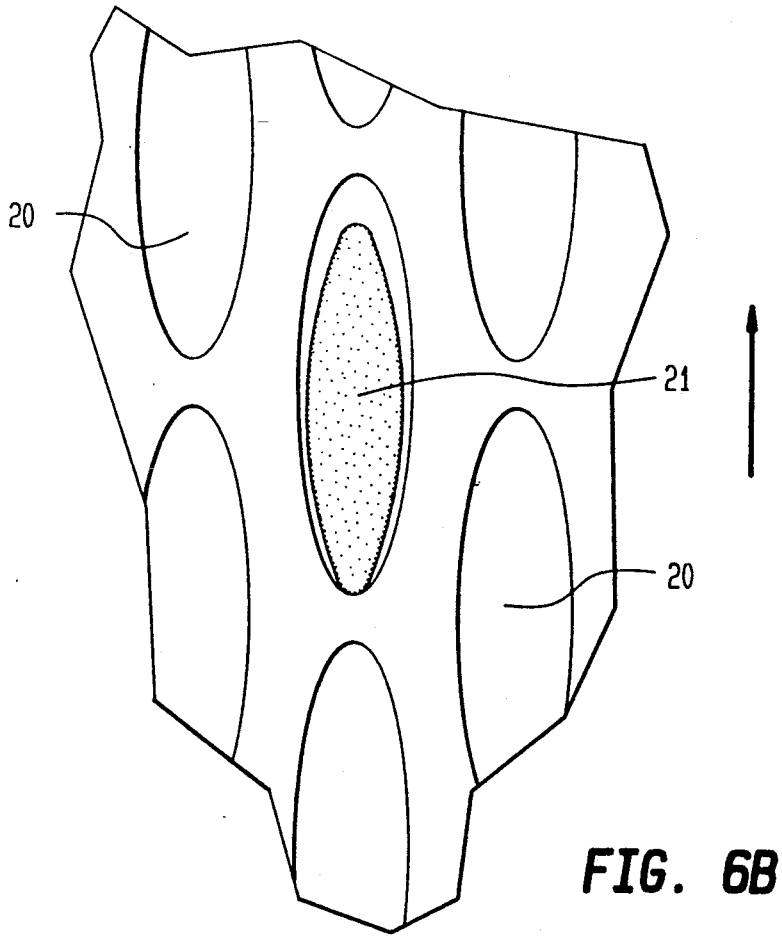

FIG. 6*b* is a front view of the pockets of FIG. 6*a*.

DETAILED DESCRIPTION

Figure 1B:
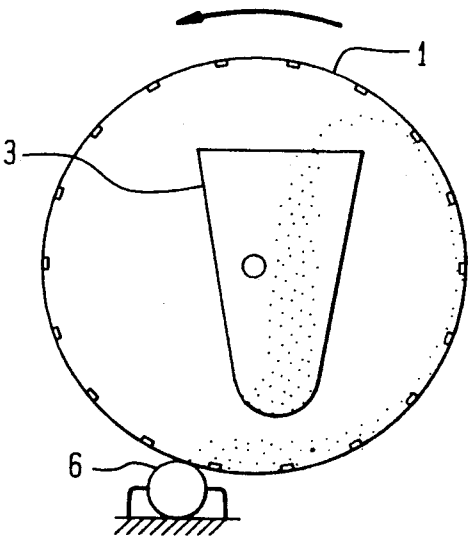
Figure 1A:
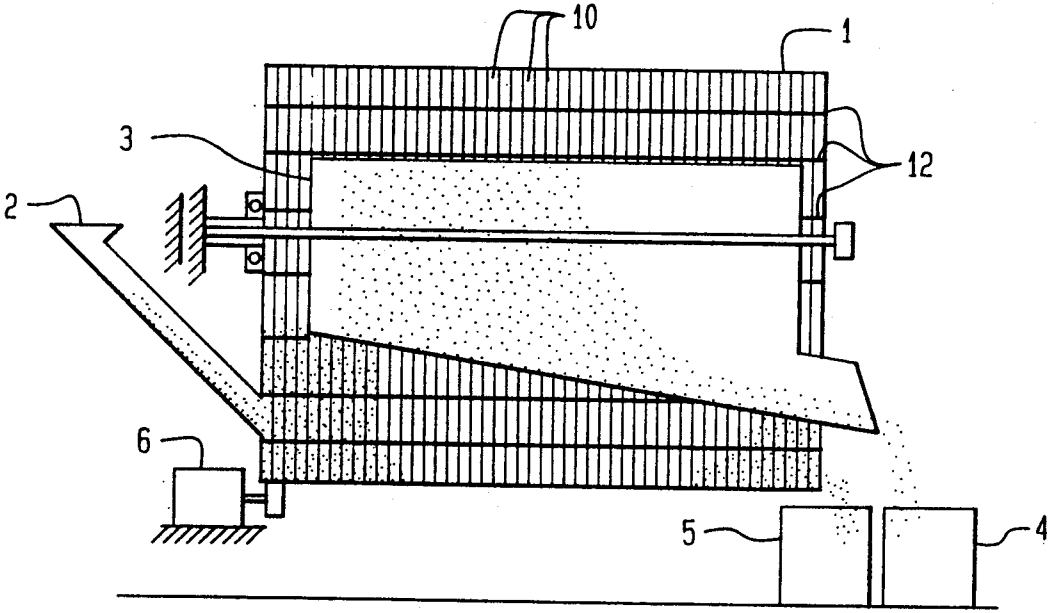

Referring first to FIGS. 1*a* and 1*b*, a typical prior art arrangement of an indent cylinder separator is illustrated therein, having a drum 1, feed hopper 2, trough 3, bin 4 for "lifted" particles, bin 5 for unlifted particles, and drum rotating means 6. The pockets are located on the interior surface of the drum wall.

As viewed in FIG. 1*b*, the particles meas or bulk mixture in the drum is referred to as a "seed kidney" because of its shape. The seed kidney has a layer of crop seed and contaminants that rotates and translates up the cylinder wall to a "turn-about" point. Above the turn-about point, centrifugal force, and physical interaction between the particles and the pockets, keeps the particles in palce in the pockets in place until the angle of rotation of the pockets is sufficient for gravity to overcome the forces holding the particles in the pockets. The particles that are lifted the highest fall into a trough 3 above the bulk mixture in the drum.

The pockets of the present invention appear in FIGS. 1*a* and 1*b* as parallel grooves 10 demarcated by ledges 12. A few of these pockets 10, in their position of vertical displacement during rotational movement of the drum, appear in the close-up views in FIGS. 2*a* and b, that also depict ledges 12. The curvature of the wall of drum 1 does not appear in these latter figures, but the arrows illustrate the direction of wall movement.

Figure 2A:
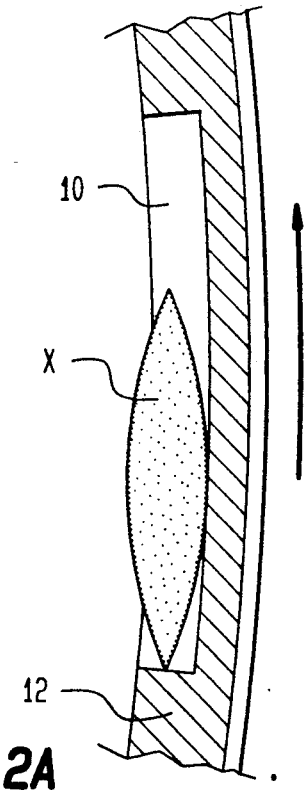
Figure 2B:
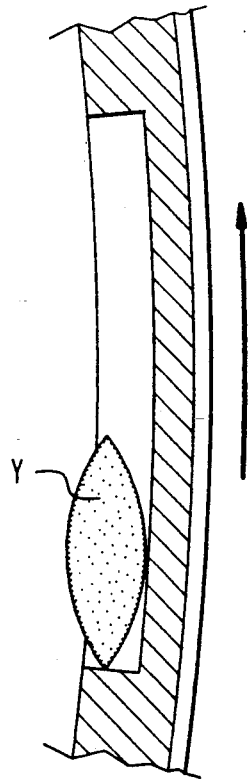

Referring thereto, it can be seen that the particle X in FIG. 2*a*, although about the same width and depth as the particle Y in FIG. 2*b*, is longer. Accordingly, as the pocket progressively is moved to a face-down displacement, an angle of ledge 12 will be reached where both particles will begin to topple out of the pocket. Due to its greater length (assuming unifrom density), the particle in FIG. 2*a* will topple at a lower angular velocity, and thus will be lifted to a higher elevation before completely escaping the pocket. In this manner, the particle in FIG. 2*a* can be caught in trough 3, while the particle in FIG. 2*b* escapes the pocket at too low an elevation to fall into the trough.

Referring now to FIGS. 3*a–d*, therein is illustrated the application of the present invention to particles having different shapes as well as length. The pockets are shown in four positions, i.e., front view 3*a*, sectional side views 3*b* and 3*c*, and bottom sectional view 3*d*. Reference numeral 13 designates a wheat seed lodged in one of the grooves, while numeral 14 designates goatgrass seed.

Figure 3A:
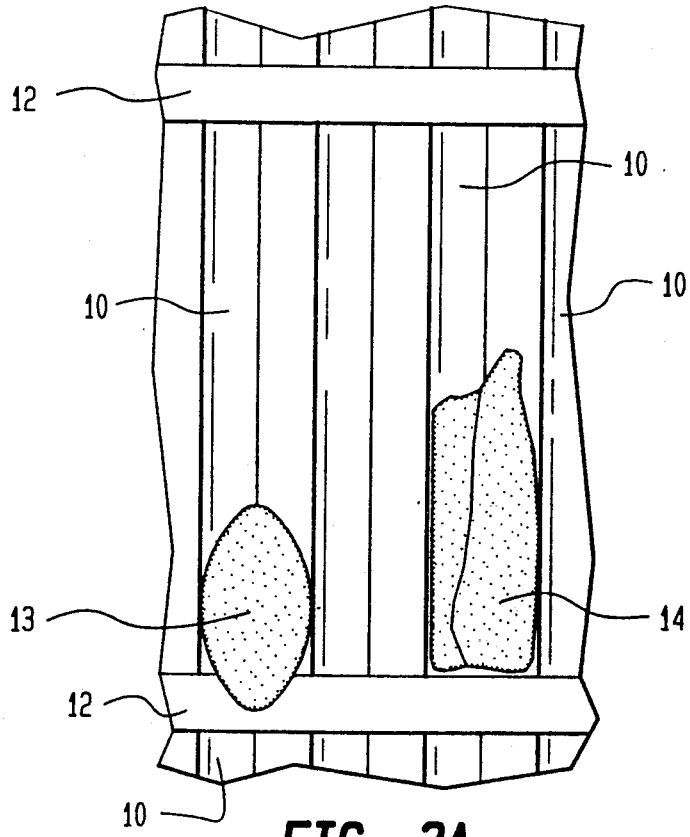
Figure 3B:
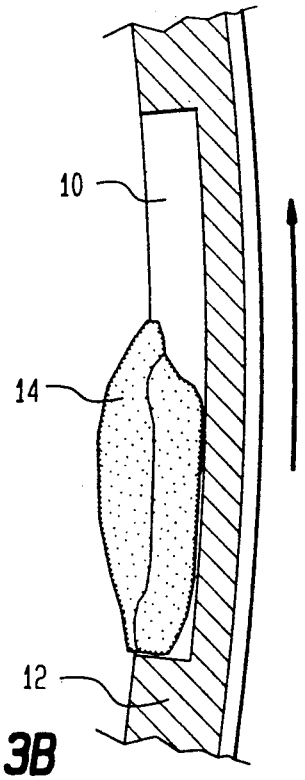
Figure 3C:
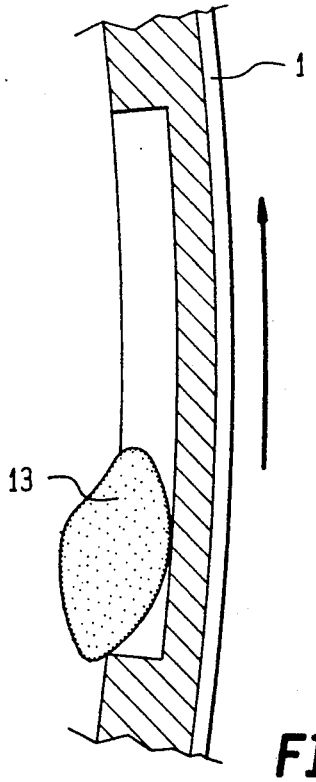
Figure 3D:
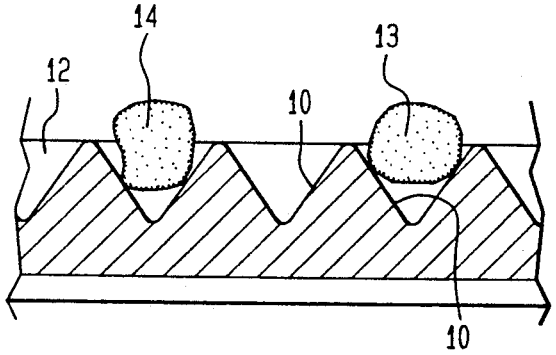

As can be seen in FIG. 3*a*, 3*b*, and 3*c*, the sides of the grooves help to orient the seeds longitudinally within the pockets, while ledge 12 provides a support for part of the bottom of each particle when the particles become vertically disposed, while the remaining part of the bottom of each particle remains unsupported. In the case of separating ellipsoid particles from cyclindrical particles having a generally flat end, the depth of the ledge preferably is at least half the depth of the particles, but preferably is not be so deep that the lowest point of the ellipsoid particle is able to rest thereon. In other words, the depth of the ledge preferably is dimensioned to provide more stable support for one of the particles than the other differently shaped particle, even though both particles are about the same width and depth. Exemplary specific dimensions of the ledge are addressed later.

As can be seen, the flat-ended goatgrass seen more stably rests on ledge 12 than the wheat seed, due to the rounded shape of the wheat seed, thereby enabling some of the wheat seed to begin to exit from its respective pocket before goatgrass seed.

Some of the wheat seed may be stable enought to delay the onset of departure from the pockets until ledge 12 reaches an angle that causes both the wheat seed and goatgrass seed to begin toppling. At such time, the shorter wheat seeds will topple more rapidly, and thereby completely escape their respective pockets before the longer goatgrass, for the reasons explained above.

Thus the overall effect is that goatgrass seed is lifted to a higher elevation above the bulk material than wheat seed, as the drum continues to rotate (see FIGS. 1*a* and 1*b*).

It will be understood that individual particles are able to lodge in the grooves with ends oriented in one of two directions, 180° apart. In the case of wheat (ellipsoidal particles), the particles unstably are lodged therein in eighter direction. In the case of a goatgrass seen particle that is roughly cylindrical, but with one end blunter than the other, it is possible for the more rounded end to be lodged adjacent ledge 12, so that, despite its favorable length, the goatgrass seed will be lodged unstably in a pocket, and will not be lifted high enough to have a trajectory that is intercepted by the trough the first try. This will result in the particle returning to the bulk material. However, it will have numerous other opportunities to be lodged in a stable position in a pocket, and lifted to a high elevation, as this is the nature of the indent cylinder machine.

Other particles that are lifted in a wheat/goatgrss seed separation include small, and shriveled wheat seed. Such undesirable seed can sit deeper in the grooves despite respective shapes, and thereby more strongly interact with the pockets, so as to be lifted as high as the undesirable larger goatgrass before disengaging from the pockets. In this manner, these undesirable small particles are removed by the trough together with the goatgrass.

With regard to materials of construction, the wall of drum 1 may be fabricated of rolled steel, while the grooves 10 and barrier or ledge 12 may be metal, rubber, or other elastomeric material, glued or otherwise secured to the drum wall be conventional means such as bolts. As an alternative to one piece ledge-groove construction, the grooves and ledges may be different pieces fabricated from the same or different materials. For example a plurality of parallel ledges may be directly bolted to the interior of the drum wall, and thereafter a plurality of wholly separate groove pieces may be secured directly to the wall in the spaces between the ledges; or the grooves may be constructed of one unitary piece that covers the entire internal cyclindrical wall of the drum, but may include a series of transverse cut-outs or recesses to accept the ledges.

Figure 4:
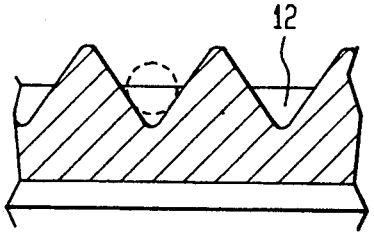
FIG. 4 is a cross-sectional view of alternative pockets.

Another modification is shown in FIG. 4. In this arrangement, the groove dimensions are great enough so that particles are lodged completely within the grooves. However, the ledge dimensions (depthwise) remain the same as in FIGS. 3*a–d*.

Figure 5:
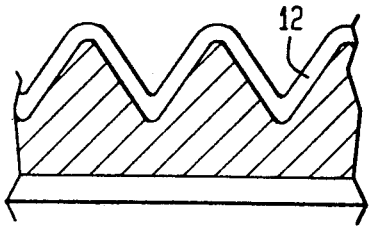
FIG. 5 is a cross-sectional view of yet other alternative pockets.

In a further modification, the ledge 12 may conform to the serpentine configuration of grooves 10 in cross-section, as illustrated in FIG. 5.

In yet another modification, the grooves may be u-shaped.

Dimensionwise, the width and depth of the grooves may range from slightly smaller, e.g., FIGS. 3*a–d*, to slightly larger than the width of the particles to be lifted, as shown in FIG. 4. For a typical wheat seed-goat grass seed separation, the v-grooves may be about 0.12 inches in width and 0.05 inches in depth (design of FIG. 3*d*) to about 0.24 inches in width and 0.12 inches in depth (FIG. 4). (Wheat seed typically is about 0.12 inches in depth and 0.25 inches long; and goat grass seed is about 0.12 inches in depth, and 0.5 inches long.) Typically the grooves are about 1 to 5 times longer, preferably about 3 times longer, than the longer of the two particles being lodged therein. For a wheat seed-goat grass seed separation, groove length should be about 1.5 inches. In the designs of either FIGS. 3*d* or 4, the depth of ledge 12 is the same, e.g., about 0.05 inches.

Typical drum diameters are about 12 to 30 inches in diameter. Tangential drum speeds will vary depending upon the mass of the particles to be separated. For wheat/goatgrass separations, tangential velocity of the drum should be about 10 ft/min to 200 ft/min, preferably about 90 ft/min which translates into about 30 rpm for a 12 inch diameter drum.

FIGS. 6*a* and 6*b* illustrate an alternative design of the pockets. In this embodiment the pockets consist of a series of identical, elongated, staggered pockets or grooves 20 in the internal wall surface of the drum 1. As shown therein, at least part of such a pocket generally conforms to the shape of the longer of the particles 21 to be separated, so that the shorter particles are apt to be less stably lodged therein and thereby more prone to escape the pockets at a lower elevation than the longer ones.

While the present invention is suitable for separating longer particles from shorter ones, it also may separate two kinds of particles of the same size, shape and mass, but differing in location of center of mass, wherein one of the particles has a lower center of mass than the other with respect to the support ledge of the pocket. As explained earlier, when both of these particles begin to topple from the pockets at the critical angle of the upstream pocket ledge, the particles having the higher center of mass will topple slower than those with the lower center of mass, thereby effecting a separation between the two kinds of particles. a substantial separation may be achieved by this embodiment provided that one of the two particles has a center of mass that results in its toppling out of a pocket at an elevation below the collection tray, no matter which of the two possible longitudinal directions that such particle may lodge in a pocket.

The location of center of mass, besides influencing the toppling speed of a particle, also may influence the stability of a particle resting on a pocket's upstream ledge. For example, on some occasions, the center of mass of one particle may be located within the confines of a pocket, while the center of mass of the other particle may be located external to the pocket face. Under such an arrangement, the particle with the outside-the-face center of mass particle obviously will be somewhat more unstable on the ledge, and may tend to begin its toppling action sooner than the other particle. However, for most kinds of envisioned particle separations, the inside-outside center of mass differential will not have a significant effect upon separation.

What is claimed is:

1. A rotary drum separator having a plurality of elongated pockets that are elongated in the direction of pocket movement, wherein first and second kinds of particle in a bulk mixture in the drum longitudinally may lodge in said pockets; wherein each of said pockets includes a generally flat upstream surface so that a particle longitudinally lodged therein partly rests or stands upon the generally flat surface when elevated above said bulk mixture; wherein said pockets provide (a) means to permit said first kind of particles lodged therein to escape said pockets at a lower elevation than said second kind of particles lodged therein, and (b) means to direct said first kind of escaped particles directly to said bulk mixture in said drum.

2. The apparatus of claim 1 wherein said pockets comprise a series of side by side circumferential grooves in said drums's interior surface.

3. The apparatus of claim 1 wherein said pockets comprise a series of staggered indentations in said drum's interior surface, each of which conforms to the shape of said particles longitudinally lodged therein.

4. The apparatus of claim 1 wherein the depth of each pocket is less than the width or depth of said particles that longitudinally lodge therein.

5. The apparatus of claim 2 wherein the depth of each pocket is less than the width or depth of particles that longitudinally lodge therein.

6. A method of separating particles in a bulk mixture in a rotary drum separator comprising a. lifting first and second particles out of said bulk mixture by means of pockets; wherein said first particles are about the same width and depth, but are shorter than, said second particles;

b. causing said first and second particles to begin toppling out of said pockets at about the same elevation above said bulk mixture, but causing said first particles to topple out more rapidly than said second particles, so that said first particles completely escape their respective pockets at a lower elevation above said bulk mixture than said second particles.

7. The method of claim 6 further wherein said first particles have a different shape than said second particles so that some of said first particles less stably are lodged in said pockets than said second particles, wherein said method further comprises causing some of said first particles to completely exit from said pockets at a lower elevation above said bulk mixture than said second particles, as a result of said difference in shape.

8. The method of claim 7 where said first particles are generally ellipsoidal, and said second particles are generally cylindrically shaped with at least one generally flat end.

9. The method of claim 8 wherein said first particles are wheat seeds, and said second particles are goat grass seeds.

10. A method of separating particles in a bulk mixture in a rotary drum separator comprising a. lifting first and second particles out of said bulk mixture by means of pockets; wherein said second particles are about the same shape, size, and mass as said first particles, but have a higher center of mass than said first particles relative to point of support in respective pockets;

b. causing said first and second particles to begin toppling out of said pockets at about the same elevation above said bulk mixture, but causing said second particles to topple out more slowly than said first particles, so that the second particles completely escape their respective pockets at a higher elevation above said bulk mixture than said first particles.

11. In a method for separating wheat seed from jointed goat grass seed in a bulk mixture in a rotary drum separator, the improvement comprising lifting said goat grass seed out of said bulk mixture in said drum by means of pockets, so that remaining bulk mixture becomes enriched with said wheat seed by allowing said wheat seed to fall back into the bulk mixture in said drum, wherein said goat grass seed is longer than said wheat seed.

* * * * *